United States Patent [19]

Schiele

[11] Patent Number: 4,784,634

[45] Date of Patent: Nov. 15, 1988

[54] SOLID BOWL CENTRIFUGE

[75] Inventor: Herbert Schiele, Karlsfeld, Fed. Rep. of Germany

[73] Assignee: Krauss-Maffei A.G., Fed. Rep. of Germany

[21] Appl. No.: 26,182

[22] Filed: Mar. 16, 1987

[30] Foreign Application Priority Data

Mar. 14, 1986 [DE] Fed. Rep. of Germany ..... 3608664

[51] Int. Cl.[4] ..... B04B 1/20

[52] U.S. Cl. ..... 494/52; 494/56; 494/10; 494/2

[58] Field of Search ..... 366/184; 222/491; 494/1, 2, 3, 7, 10, 27, 40, 42, 50, 52, 53, 54, 56

[56] References Cited

U.S. PATENT DOCUMENTS

| | | | |
|---|---|---|---|
| 2,532,792 | 12/1950 | Svensjo . | |
| 3,228,594 | 1/1966 | Amero | 494/53 |
| 3,279,687 | 10/1966 | Amero | 494/27 |
| 3,279,688 | 10/1966 | Cook | 494/10 |
| 3,501,346 | 3/1970 | Katzen et al. | 494/42 |
| 3,795,361 | 3/1974 | Lee | 494/53 |
| 4,378,906 | 4/1983 | Epper . | |
| 4,617,010 | 10/1986 | Epper . | |

FOREIGN PATENT DOCUMENTS

| | | |
|---|---|---|
| 0159422 | 10/1985 | European Pat. Off. . |
| 2344507 | 3/1974 | Fed. Rep. of Germany . |
| 3027020 | 2/1982 | Fed. Rep. of Germany . |
| 3317047 | 1/1984 | Fed. Rep. of Germany . |
| 3301099 | 12/1984 | Fed. Rep. of Germany . |
| 2143011 | 1/1984 | United Kingdom . |

OTHER PUBLICATIONS

Stromungs-und Bewegungsvorgange in Deranterzentrifugen, Chemie-Ing. Techn., 41., Jan. 1969, Nos. 5 and 6.

*Primary Examiner*—Robert W. Jenkins
*Assistant Examiner*—J. Dwight Poffenberger, Jr.
*Attorney, Agent, or Firm*—Robert J. Koch

[57] ABSTRACT

A solid bowl centrifuge for dewatering sludge exhibiting a conical solid bowl and an inner rotor part which revolving at different speeds and has apparatus for axially transporting solid components for improved separating and reduced energy consumption. The sludge is introduced at a tapered end and solid components are discharge at an expanded end. Introduction of sludge is effected through a radial inlet channel(s). Surface elements are attached to the inner rotor by holder arms and are located at a slight distance from the inner wall of the solid bowl drum. A surface element free axial passage channel is defined between the inner rotor wall and the solid bowl drum extending at least 50% of the radial distance between the rotor wall and the drum. A baffle plate is mounted on the inner rotor at the wide end of the drum leaving an annular gap or passage between a compacting space and a sediment discharge which exhibits a radially inwardly directed sediment outlet channel(s). The separated liquid is drained through a liquid outlet channel(s) from the compacting space. The liquid outlet is mounted on the inner rotor.

20 Claims, 2 Drawing Sheets

SOLID BOWL CENTRIFUGE

BACKGROUND OF THE INVENTION

1. Field of the Invention

The invention relates to a solid bowl centrifuge and more particularly to a sludge dewatering centrifuge with a conical bowl drum.

2. Description of the Related Technology

DE-OS No. 3 301 099 incorporated by reference herein shows a centrifuge where the solids settling on the inner wall of the solid bowl drum and the liquid clear phase are discharged from a conically expanded zone of the solid bowl centrifuge. Baffle plates are attached to the solid bowl drum and an internal rotor, they penetrate the settling slurry phase in the entire radial fill level. The baffle plates agitate the slurry phase by imparting axially and circumferentially directed flow components. These baffle plates simultaneously affect the solid and the liquid phase and cause a mixing effect which acts against the desired separation of the soild and liquid phases. In addition to this swirl produced by the baffle plates, a further disadvantage lies in the relatively high amount of energy required to operate the centrifuge as both phases are thrown radially outward upon their discharge from the solid bowl drum without energy recovering measures.

SUMMARY OF THE INVENTION

It is an object of the invention to provide an improved solid bowl centrifuge for increased separation effect with a reduction in energy consumption.

According to the invention the solid bowl centrifuge for dewatering of sludge has a conical solid bowl drum and an inner rotor part which rotates relative to the drum. The inner rotor part exhibits devices for the axially transporting solid sludge components. The sludge is introduced at a conically tapered end of the centrifuge drum and the solid sludge components are discharged at a conically expanded end of the solid bowl drum. The sludge is introduced through one or more radial sludge inlet channels. Apparatus for axially transporting solid sludge components settling on the inner wall of the solid bowl drum is provided which exhibits one or more surface elements attached to the inner rotor part. The surface elements may be moved at a slight distance from, and at an appropriate relative velocity past the inner wall of the solid bowl drum. The surface element may advantageously be arranged on holding arms, where an axial passage channel free of surface elements is provided between the inner rotor and the surface elements. The channel may advantageously amount to at least 50% of the radial distance between the wall of the inner rotor part and an inner wall of the solid bowl drum. A baffle plate may be mounted in the area of the conically expanded end of the solid bowl drum on the inner rotor part. The baffle plate and the inner wall of the solid bowl drum define an annular gap at the wide end of the drum. The annular gap represents the passage opening from a compacting space located in front of the baffle plate to a sediment discharge space located behind the baffle plate. Advantageously one or more radially inwardly directed sediment outlets connected a sediment discharge channel lead from the sediment discharge space outside the solid bowl drum. The liquid separated from the sediment is drained from a compacting space by one or more liquid outlet channels mounted on the inner rotor part which extend radially inward and pass into a liquid discharge channel leading outside the solid bowl drum.

The invention provides for accumulating the clear phase or liquid components in the radially inner area of the drum. The components of the heavy phase or solids have sedimented out, to a very large extent, from the radially inner area. An unimpeded axial flow with a light spiral flow component may be established in a radially inner flow space without entrainment of heavy phase components, sedimenting in the radially outer area, by said flow. The heavy phase components are held within or in the area of surface elements located in a radially outer area of said drum and are somewhat shielded against flow of the clear phase in the radially inner area. Swirling caused by baffle plates which extend simultaneously through both phase zones is thereby prevented. Although DE-OS No. 3 301 099 (FIG. 3) shows surface elements mounted on holding arms, which may be moved at a slight distance past the inner wall of the solid bowl drum and which extend only slightly in the radial direction these surface elements are flanked on both sides by closed helical blades defining flow channel with a small flow cross section. High flow velocities are generated in the flow channel and no quieted flow favoring sedimentation of the clear phase may be established.

According to the invention quiet guidance of the flow is further favored by the radially directed slurry inlet channels which insure that the slurry is introduced with a flow component already accelerated to the circumferential velocity in the vicinity of the inner wall of the solid bowl drum. The development of a radial velocity profile comprising shear flows interfering with the separation process may thereby be avoided and the sedimentation process may begin effectively at the onset or initial portion of the drum (feed side).

In addition to shielding the sedimented heavy phase against the flow prevailing in the radially inner zone, of the lighter clear phase largely depleted of heavy components, the surface elements employed, for example, in the form of a ribbon screw impart intense shear stress to the sediments. The sediments are backed up against the baffle plate under the increasing compression effect and spill against the axial transport direction of the ribbon screw over the inner edge of the screw or surface elements. These shear forces acting during this constant shifting of layers of the sedimented phases, favor the further compacting of the solid phase components.

To optimize these consolidating effects occurring in front of the baffle plate, a throttle with a variable throttle cross section may be placed in the sediment discharge area. The throttle may be actuated by a device measuring the viscosity of the sediment, connected in line with the throttle.

A further advantageous device for optimization of the consolidation effect developing in front of the baffle plate, a variable throttle may be arranged in the clear phase discharge area. This throttle may be actuated by a device measuring viscosity located in the sediment discharge area.

The cross-sectional area of the throttle may be varied by an axial displacement of the baffle plate, whereby the width of the annual gap bounded by the edge of the baffle plate and the inner wall of the drum may be regulated in the area of the conically expanding drum. The throttling device may be advantageously a device for varying the level of material taken up through the radial outlet channels.

A plurality of openings closed by closure flaps are provided in an annular zone of the solid bowl drum to limit the sediment discharge space to the outside in order to insure continuous operation of the solid bowl centrifuge and secure against clogging by coarse particles.

Coarse particles may settle in recesses formed by such closed openings. Accumulated course particles are detected by a course matter sensor mounted on the baffle plate. Integration of the accumulation and the coarse matter sensor tends to brake or block the relative motion of the baffle plate and outer drum. A torque sensor device located in the drive unit for the inner rotor part and the solid bowl drum detects the breaking and generates a control pulse to actuate a brief opening of the closure flaps. Coarse particles may be discharged to the outside into an annular collecting gutter in this fashion.

BRIEF DESCRIPTION OF THE DRAWING

An embodiment of the invention is described below with reference to the drawings.

DETAILED DESCRIPTION OF THE PREFERRED EMBODIMENT

Figure 1:
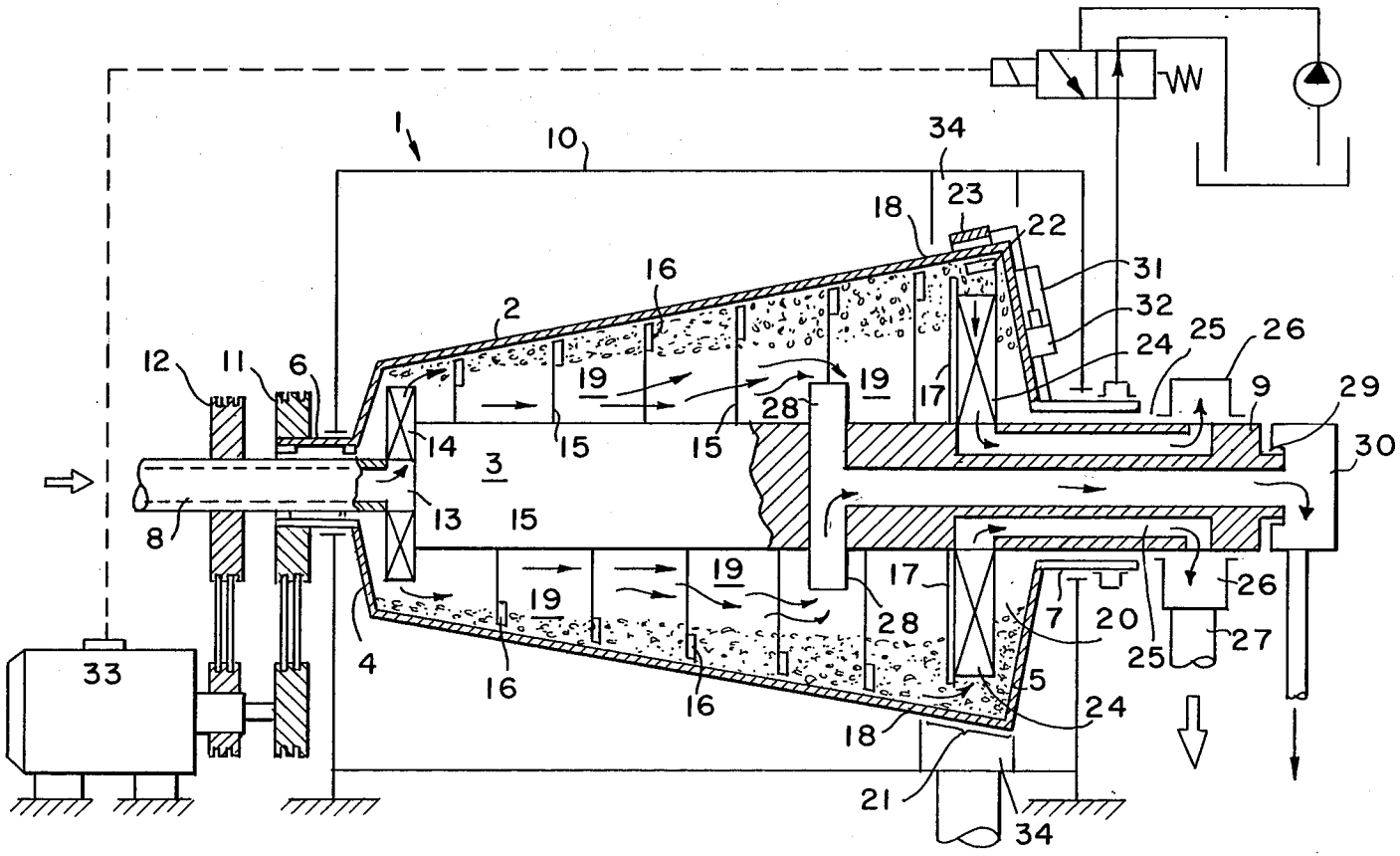
FIG. 1 shows a schematic view of an axial section through a solid bowl centrifuge.

The solid bowl centrifuge 1 comprises a closed conically expanding solid bowl drum 2 and an inner rotor part 3 coaxially supported therein. The solid bowl drum 2 exhibits hollow shafts 6 and 7 on its two frontal surfaces 4 and 5. The shaft parts 8 and 9 of the inner rotor part 3 extends through hollow shafts 6 and 7, respectively. The hollow shafts 6 and 7 are bearingly supported in a housing 10 which encloses the solid bowl drum 2. The inner rotor part 3 is supported in the hollow shafts 6 and 7 by the shaft parts 8 and 9.

A v-belt pulley 11 and 12 each is located on the hollow shaft 6 and the shaft part 8, respectively at the conically tapering end of the solid bowl drum 2. The solid bowl drum 2 and the inner rotor part 3 may thereby be driven at a slight difference rpm. This may be achieved by utilizing pulleys 11 and 12 having slightly different diameters.

A feed channel 13 for sludge is located at the conically tapering end of the solid bowl drum 2 in the form of a hollow bore provided in the shaft part 8. The feed channel 13 may branch inside the solid bowl drum 2 into radial sludge inlet channels 14.

Figure 2:
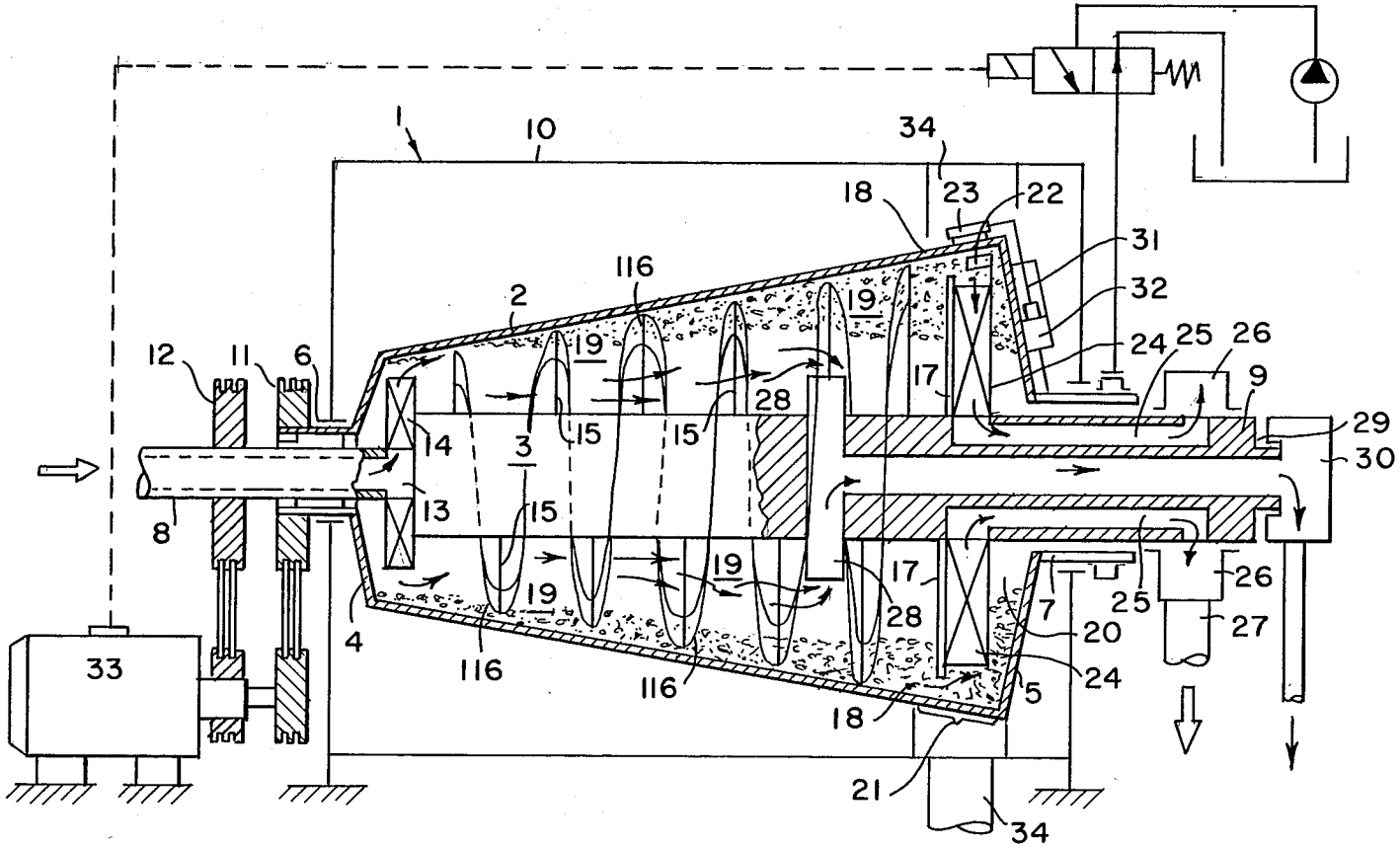
FIG. 2 shows an embodiment with a screw ribbon.

The inner rotor part 3, inside the solid bowl drum 2, carries thin holder arms 15 exhibiting a plurality of surface elements 16. The surface elments 16 are arranged at a slight distance from the inner wall for the solid bowl drum 2 and only extend a small distance radially. The surface elements are arranged so as to impart a transport impulse to sludge particles introduced into the drum 2 upon rotation of the inner rotor part 3. The transport impulses are directed toward the conically expanded end of the drum 2. In place of individual surface elements, a continuous ribbon screw 116 may also be used (FIG. 2). Similarly, conveying means with essentially the same action, such as paddle screws and scrapers set obliquely with respect to the principal axis of the solid bowl centrifuge, may be employed. The number and profile of the holder arms may advantageously be minimized in order to minimize their affect on the radially inner flow path and avoid introducing unnecessary swirling.

A baffle plate 17 is mounted within the drum 2 at the conically expanded end on the inner rotor part 3. The edge of the plate and the inner wall of the drum 2 define an annular gap 18. The baffle plate 17 divides the space enclosed by the solid bowl drum 2 between frontal surface 4 and 5 into a compacting space 19 and a sediment discharge space 20. An annular space or surface 21 of the drum 2, associated with the sediment discharge space or area exhibits a plurality of openings 22 distributed over the circumference and closed by the closure flaps 23.

The baffle plate 17 carries radially inward directed sediment outlet channels 24 on the side facing the sediment discharge space 20. The radial outlet channels 24 lead to axial sediment outlet channels 25 located in the shaft part 9.

The sediment oulet channels 25 open into an annular, non-revolving collector vessel 26. A sediment discharge shaft 27 branches off the collector vessel 26.

A plurality of radially directed liquid outlet channels 28 branch off from the compacting space 19. The liquid outlet channels 28 are spaced from the baffle plate 17, and pass into an axial liquid discharge channel 29. A non-revolving line connection 30 is located at the end of the axial liquid discharge channel 29.

A coarse matter sensor 31 is fastened to the baffle plate 17, arranged in the area of the openings 22 at a small distance from the annular surface 21.

The closure flaps 23 are connected to a hydraulic actuation device 32, which may be activated by a torque sensor device (not shown) located in the drive 33. The annular surface 21 is surrounded by a non-revolving collector gutter 34.

In actual operation, the sludge is introduced into the solid centrifuge 1 in the vicinity of the inner wall of the solid bowl drum 2 by the feed channel 13 and the sludge inlet channels 14. In this fashion the sludge undergoes a large degree of acceleration, to the circumferential velocity of the solid bowl drum 2, upon its entry into the compacting space 18. This introduction of the sludge in a relatively quiet flow contributes to allowing the sedimentation process of the solid phase to begin very close to the conically tapered or narrow end of the solid bowl drum. The solid phase is seized in the radially outer zone by the surface elements 16 and conveyed toward the conically expanded or wide end of the drum 2. The radial height of the solid phase increases in the direction of conical expansion and in the area of the baffle plate 17, exceeds the radial height of the surface elements 16. The components of the solid phase back up at the baffle plate 17 and spill over the radially inner edge of said elements, against the axial transport direction due to the throttle effects in the sediment discharge zone. In a repeated sequence the sediment components are exposed to a constant shear stress, which leads to further compacting of the solid components.

The solid sediment components arrive in the sediment discharge space 20 through the annular gap 18. The sediments then pass through the sediment outlet channels 24 and the sediment discharge channels 25 into the fixed collector vessel 26. The collector vessel 26 may be emptied by the sediment discharge shaft 27.

During operation coarse particles may settle in the area of the openings 22. The coarse material accumulates and begins to impact on the coarse matter sensor 31, which revolves with the baffle plate 17. The sensor acts as a brake on the system whereby the impact causes a retardation of rotation in the drive unit 33. The torque sensor device senses the retardation caused by accumulation of coarse material and produces a control pulse transmitted to the closure flap actuating device 32 thereby opening the closure flaps 23. The opening process is only of a short duration, therefore, the removal of coarse particles may be carried out without interruption of the normal operation of the solid bowl centrifuge.

The clear phase (liquid) forming and accumulated in the radially inner area of the compacting space 19 is drained through the liquid outlet channels located on the inner rotor part 3, the liquid discharge channel in the shaft part 9 and a fixed line connection 30.

The height of the solid phase backing up in front of the baffle plate may be adjusted by a variable throttle located in the sediment discharge area. The throttle setting may be effected advantageously as a function of measured values of a device measuring viscosity of the sediment discharged.

In another embodiment of the invention a variable throttle may be arranged in the clear phase discharge zone, which may be controlled as a function of the measured values of a viscosity measuring device for the sediment being discharged.

By the two aforementioned throttles it is possible to affect the consistency or residual humidity of the sediment, in order, for example, to prevent clogging in the sediment discharge area as a result of the excessive dewatering of the sediment, or a too rapid flow of the sediment due to insufficient dewatering.

I claim:

1. A sludge dewatering centrifuge for separating liquid and solid components comprising:

a conical drum exhibiting a tapered end and an opposing wide end;

an inner rotor arranged within said conical drum;

drive means for rotating said drum and said inner rotor at different speeds, associated with said inner rotor and said drum;

radial inlet means for introducing sludge at said tapered end of said drum;

surface element means for axially transporting solid components disposed adjacent to an inner surface of said conical drum;

means for fixing said surface element means connected to said inner rotor wherein said means for fixing traverse a channel free of said surface element means defined between said inner rotor and said surface element means wherein a radial width of said channel is at least 50 % of a radial distance between said inner rotor and said inner surface of said drum;

a baffle plate connected to said inner rotor defining a compacting area on a side of said baffle plate facing said tapered end and a sediment discharge area on an opposing side of said baffle plate facing said wide end wherein said baffle plate and said drum define an annular passage between said compacting area and said sediment discharge area;

means for radially inward transport, and discharge, of solid components arranged in said sediment discharge area; and means for transport, and discharge, of liquid components arranged in said compacting area.

2. A centrifuge according to claim 1 further comprising:

passages disposed on said drum in said sediment discharge area;

closure flaps arranged over said passages; and means for moving said closure flaps to open said passages operatively associated with said closure flaps.

3. A centrifuge according to claim 2, further comprising:

means for sensing accumulation of solid components in said sediment discharge area and actuating said means for moving said closure flaps, associated with said sediment discharge area.

4. A centrifuge according to claim 3, wherein said means for sensing comprises a coarse matter sensor mounted on said inner rotor in said sediment discharge area and a torque sensor associated with said drive means and connected to said means for moving.

5. A centrifuge according to claim 4, further comprising:

a collecting gutter surrounding said drum aligned with said passages.

6. A centrifuge according to claim 4, wherein said surface element means is a screw ribbon.

7. A centrifuge according to claim 4, further comprising means for measuring viscosity of material transported through said means for radially inward transport and discharge of solid components.

8. A centrifuge according to claim 7, wherein said means for radially inward transport and discharge of solid components further comprises a variable throttle device responsive to said means for measuring viscosity.

9. A centrifuge according to claim 7, wherein said means for transport and discharge of liquid components further comprises a variable throttle device responsive to said means for measuring viscosity.

10. A centrifuge according to claim 4, wherein said means for transport and discharge of liquid components is arranged for radially inward transport of liquid components.

11. A centrifuge according to claim 3, wherein said surface element means is a screw ribbon.

12. A centrifuge according to claim 3, further comprising means for measuring viscosity of material transported through said means for radially inward transport and discharge of solid components.

13. A centrifuge according to claim 12, wherein said means for radially inward transport and discharge of solid components further comprises a variable throttle device responsive to said means for measuring viscosity.

14. A centrifuge according to claim 12, wherein said means for transport and discharge of liquid components further comprises a variable throttle device responsive to said means for measuring viscosity.

15. A centrifuge according to claim 3, wherein said means for transport and discharge of liquid components is arranged for radially inwardly transport of liquid components.

16. A centrifuge according to claim 1, wherein said surface element means is a screw ribbon.

17. A centrifuge according to claim 1, further comprising means for measuring viscosity of material transported through said means for radially inward transport and discharge of solid components.

18. A centrifuge according to claim 17, wherein said means for radially inward transport and discharge of solid components further comprises a variable throttle device responsive to said means for measuring viscosity.

19. A centrifuge according to claim 17, wherein said means for transporting and discharge of liquid components further comprises a variable throttle device responsive to said means for measuring viscosity.

20. A centrifuge according to claim 1, wherein said means for transport and discharge of liquid components is arranged for radially inward transport of liquid components.

* * * * *